US011384763B2

(12) United States Patent
Yamazaki et al.

(10) Patent No.: US 11,384,763 B2
(45) Date of Patent: Jul. 12, 2022

(54) SCROLL-TYPE FLUID MACHINE WITH COOLING FAN INCLUDING A PERIPHERAL WALL CONFIGURED TO MINIMIZE VORTICES

(71) Applicant: Hitachi Industrial Equipment Systems Co., Ltd., Tokyo (JP)

(72) Inventors: Shumpei Yamazaki, Tokyo (JP); Kosuke Sadakata, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 16/644,866

(22) PCT Filed: Mar. 9, 2018

(86) PCT No.: PCT/JP2018/009124
§ 371 (c)(1),
(2) Date: Mar. 5, 2020

(87) PCT Pub. No.: WO2019/171562
PCT Pub. Date: Sep. 12, 2019

(65) Prior Publication Data

US 2020/0284260 A1 Sep. 10, 2020

(51) Int. Cl.
*F04C 29/04* (2006.01)
*F04C 18/02* (2006.01)
*F15D 1/02* (2006.01)

(52) U.S. Cl.
CPC ..... *F04C 29/04* (2013.01); *F04C 18/0215* (2013.01); *F15D 1/02* (2013.01)

(58) Field of Classification Search
CPC ..... F01C 1/0207–0292; F01C 21/06; F04C 2/025; F04C 18/0207–0292;
(Continued)

(56) References Cited

U.S. PATENT DOCUMENTS

2002/0084138 A1* 7/2002 Weinstein ..... E04F 17/04 181/268
2010/0221134 A1 9/2010 Kanaizumi et al.
(Continued)

FOREIGN PATENT DOCUMENTS

CN 101153592 A 4/2008
EP 2 738 390 A2 6/2014
(Continued)

OTHER PUBLICATIONS

International Search Report (PCT/ISA/210) issued in PCT Application No. PCT/JP2018/009124 dated Jun. 5, 2018 with English translation (five (5) pages).
(Continued)

*Primary Examiner* — Laert Dounis
(74) *Attorney, Agent, or Firm* — Crowell & Moring LLP

(57) ABSTRACT

A scroll-type fluid machine includes a fixed scroll, an orbiting scroll, a drive shaft, a cooling fan, and a cooling air duct. In a bent portion, immediately adjacent to the cooling fan, where a direction of the cooling air duct is changed from a direction perpendicular to the drive shaft to a direction of the drive shaft, a part of an outer peripheral wall which is distant from the drive shaft is planar and defines a plane which intersects a plane perpendicular to the drive shaft at an obtuse angle. With this configuration, a main stream of the cooling air is prevented from separating from an inner peripheral wall of the bent portion.

9 Claims, 4 Drawing Sheets

(58) Field of Classification Search
CPC ..... F04C 29/04–042; F04C 15/0096; F04D 29/42–4293; F15D 1/02–06
See application file for complete search history.

(56) References Cited

U.S. PATENT DOCUMENTS

| | | | | |
|---|---|---|---|---|
| 2012/0189480 | A1* | 7/2012 | Yamazaki | F04C 18/0253 418/55.2 |
| 2014/0154122 | A1* | 6/2014 | Sadakata | F04C 18/0215 418/55.1 |
| 2016/0053760 | A1 | 2/2016 | Theelen et al. | |
| 2020/0309125 | A1 | 10/2020 | Yamazaki et al. | |

FOREIGN PATENT DOCUMENTS

| | | | | |
|---|---|---|---|---|
| EP | 3 486 490 | A1 | | 5/2019 | |
| JP | 5-78988 | U | | 10/1993 | |
| JP | 2000-152562 | A | | 5/2000 | |
| JP | 2002-276571 | A | | 9/2002 | |
| JP | 2002276573 | A | * | 9/2002 | |
| JP | 2010-203289 | A | | 9/2010 | |
| JP | 2013-185472 | A | | 9/2013 | |
| JP | 2013185472 | A | * | 9/2013 | |
| JP | 2016-514792 | A | | 5/2016 | |
| KR | 20100098308 | A | * | 9/2010 | F04C 18/0215 |
| WO | WO 2018/008132 | A1 | | 4/2019 | |
| WO | WO 2018/011970 | A1 | | 4/2019 | |

OTHER PUBLICATIONS

Japanese-language Written Opinion (PCT/ISA/237) issued in PCT Application No. PCT/JP2018/009124 dated Jun. 5, 2018 (four (4) pages).
English translation of Japanese-language Office Action issued in Japanese Application No. 2020-504607 dated Jun. 7, 2021 (seven (7) pages).
Extended European Search Report issued in European Application No. 18908693.7 dated Jul. 14, 2021 (10 pages).
Chinese-language Office Action issued in Chinese Application No. 2018800543316.5 dated Feb. 7, 2022 with English translation (18 pages).

* cited by examiner

SCROLL-TYPE FLUID MACHINE WITH COOLING FAN INCLUDING A PERIPHERAL WALL CONFIGURED TO MINIMIZE VORTICES

TECHNICAL FIELD

The present invention relates to a scroll-type fluid machine.

BACKGROUND ART

Patent Document 1 discloses a scroll-type fluid machine that introduces cooling air discharged from a cooling fan to the fluid machine through a cooling air passage including a bent portion to perform cooling.

Patent Document 2 discloses a scroll-type fluid machine in which the radius of a bent portion of a cooling air passage is set large to allow cooling air to flow efficiently.

CITATION LIST

Patent Document

Patent Document 1: JP 2013-185472 A
Patent Document 2: JP 2016-514792 A

SUMMARY OF THE INVENTION

Problems to be Solved by the Invention

In the scroll-type fluid machine, the compression heat of a fluid or the heat generation in a bearing causes a temperature rise in each part of the scroll-type fluid machine. Since the temperature rise in a compression chamber causes a decrease in the efficiency of compression, thus leading to a decrease in performance, and the temperature rise in the bearing causes the deterioration of the component, thus leading to a reduction in reliability, it becomes important to efficiently cool the fluid machine.

In the scroll-type fluid machine disclosed in Patent Document 1, the cooling air passage through which the cooling air discharged from the cooling fan flows to components forming the compression chamber or the vicinity of the bearing includes the bent portion that changes the flow direction of the cooling air from a radial direction of the cooling fan to an axial direction; however, since the cooling air flows on an outer peripheral side of the bent portion because of the centrifugal force, a vortex is generated on an inner peripheral side thereof to prevent the cooling air from flowing efficiently.

The scroll-type fluid machine disclosed in Patent Document 2 has a structure where the radius of the bent portion of the cooling air passage is set large to allow cooling air to flow efficiently. Since the dividing planes of components forming the cooling air passage are a plurality of planes which are disposed diagonally to each other, a mold for producing each component is not formed by one plane and becomes large in a height direction, and thus, there is a problem in cost or productivity.

Accordingly, an object of the present invention is to provide a scroll-type fluid machine that has an improved reliability without a reduction in productivity by adopting a simple shape of a cooling air passage to allow a cooling air to flow efficiently.

Solutions to Problems

The present invention has been made in light of the foregoing background art and problem, and as one example of the present invention, there is provided a scroll-type fluid machine including a fixed scroll that is provided with a lap portion having a spiral shape; an orbiting scroll that is provided with a lap portion having a spiral shape which forms a compression chamber between the lap portion of the fixed scroll and the lap portion; a drive shaft that is connected to the orbiting scroll and rotates to cause the orbiting scroll to orbit; a cooling fan that is provided on a side of the drive shaft, the side being opposite to the orbiting scroll, to generate a cooling air; and a cooling air duct through which the cooling air generated by the cooling fan flows to the fixed scroll and the orbiting scroll, in which in a bent portion where a direction of the cooling air duct is changed from a direction perpendicular to the drive shaft to a direction of the drive shaft, a part of an outer peripheral wall which is distant from the drive shaft is formed by a plane which intersects a plane perpendicular to the drive shaft at an obtuse angle.

Effects of the Invention

According to the present invention, it is possible to provide the scroll-type fluid machine which allows the cooling air to efficiently flow through a cooling air passage to cool the fluid machine without a reduction in productivity and have an improved reliability.

MODE FOR CARRYING OUT THE INVENTION

Figure 1:
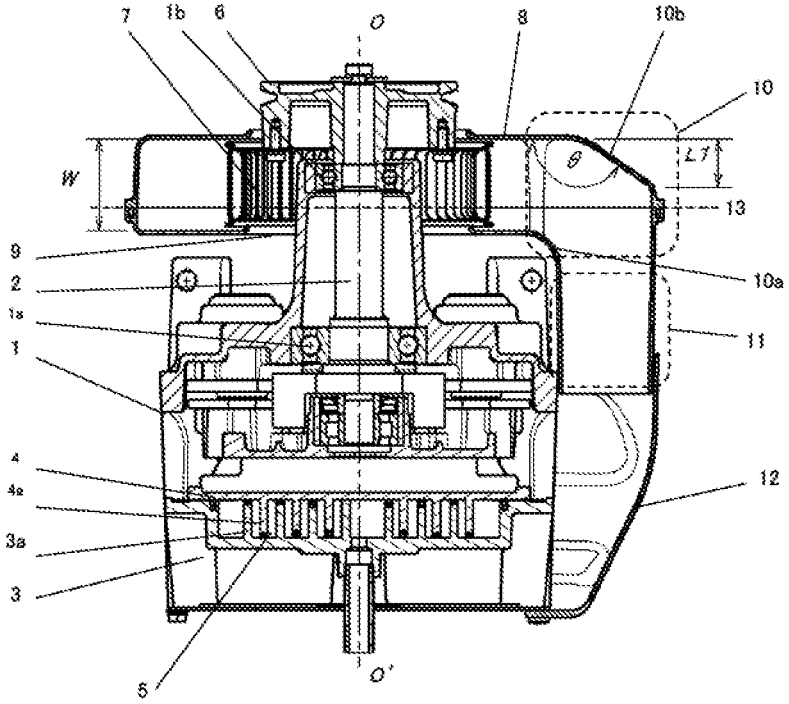
FIG. 1 is a cross-sectional view of a scroll-type fluid machine in a first example.

Hereinafter, as an example of a scroll-type fluid machine in examples of the present invention, a scroll-type compressor will be described with reference to the accompanying drawings. Incidentally, in the drawings for describing the examples, the same part names and reference signs will be assigned to the same components, and the repeated descriptions thereof will be omitted.

First Example

FIG. 1 illustrates a cross-sectional view of a scroll-type compressor in this example. In FIG. 1, reference sign 1 denotes a casing that forms an outer shell of the scroll-type compressor, and the casing covers a drive shaft 2 that is rotatably supported on a bearing 1*a* and a bearing 1*b* thereinside. Reference sign 3 denotes a fixed scroll which is provided on an opening side of the casing 1 and in which a fixed scroll lap portion 3*a* having a spiral shape is erected. Reference sign 4 denotes an orbiting scroll in which an orbiting scroll lap portion 4*a* having a spiral shape is erected. The orbiting scroll lap portion 4*a* is disposed to face the fixed scroll lap portion 3*a*, so that a compression chamber 5 is formed.

An eccentric portion (not illustrated) is provided in an end portion of the drive shaft 2, and is rotatably connected to the end portion via the orbiting scroll, the bearing, and the like. A power transmission mechanism such as a pulley 6 is provided on an end surface of the drive shaft 2, the end surface being opposite to the orbiting scroll, and is connected to an electric motor or the like (not illustrated) which is a drive source, so that the drive shaft 2 is rotated to drive an orbiting scroll 4. The orbiting scroll 4 is provided with a rotation preventive mechanism (not illustrated) and is driven to orbit with respect to a fixed scroll 3 by the drive shaft 2 to reduce the compression chamber 5 toward a center thereof, so that gas which is taken in from outside is compressed. Incidentally, the pulley 6 can also be a power transmission mechanism such as a coupling, or a rotor can be also directly attached to the drive shaft to be able to rotate.

In addition, a cooling fan 7 is attached to a side of the drive shaft 2, the side being opposite to the orbiting scroll 4, and rotates as the drive shaft 2 rotates, so that cooling air is generated in a direction which is a radial direction of the cooling fan and is perpendicular to the drive shaft 2. The cooling fan 7 is accommodated in a cooling air duct 8, and cooling air which is suctioned from a suction port 9 provided in a direction (hereinafter, simply referred to as an axial direction) of the cooling air duct 8, the direction being aligned with the drive shaft 2, is pushed into the cooling air duct 8 by the cooling fan 7.

Figure 2:
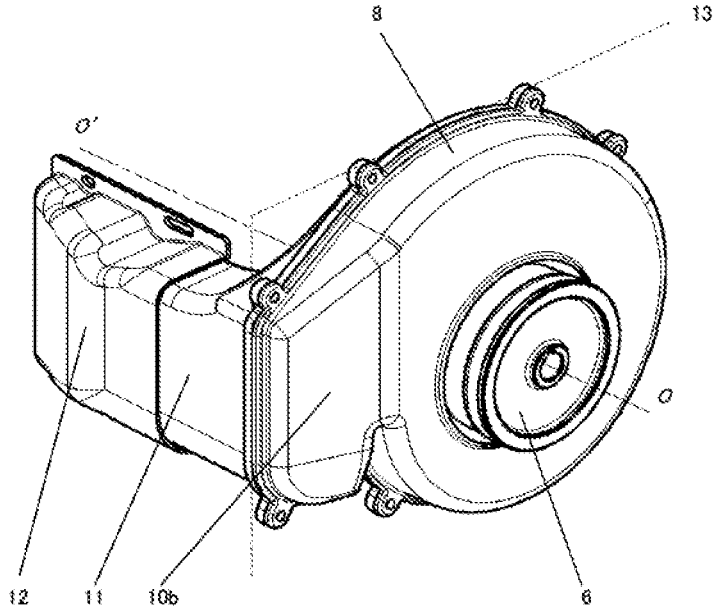
FIG. 2 is a schematic perspective view of a duct that forms a cooling air passage of the scroll-type fluid machine in the first example.

FIG. 2 is a schematic perspective view of the cooling air duct that forms a cooling air passage of the scroll-type fluid machine in this example. In addition, FIG. 3 is a schematic perspective view of the cooling air duct as viewed from a direction opposite to the view direction of FIG. 2.

Figure 3:
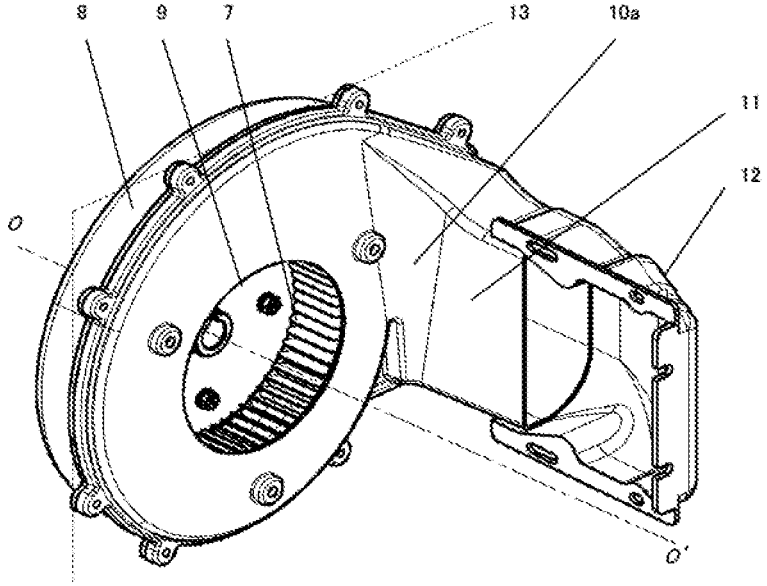
FIG. 3 is a schematic perspective view of the duct that forms the cooling air passage of the scroll-type fluid machine in the first example as viewed from a direction opposite to the view direction of FIG. 2.

As illustrated in FIGS. 1 to 3, the cooling air duct 8 includes a first cooling air passage that covers the cooling fan 7 and is disposed along the direction perpendicular to the drive shaft 2; a second cooling air passage 11 that extends in the direction of the drive shaft 2; a bent portion 10 that connects the first cooling air passage to the second cooling air passage; and an introduction duct 12 that is connected to the second cooling air passage 11 to supply the cooling air to the fixed scroll 3 and the orbiting scroll 4. The cooling air which is suctioned from the suction port 9 passes through the bent portion 10 provided in the cooling air duct 8, so that the flow direction of the cooling air is changed toward the cooling air passage 11 extending in the axial direction, and the cooling air is supplied around the fixed scroll 3 and the orbiting scroll 4 via the introduction duct 12 to cool each component of which the temperature is raised by heat generated from the foregoing compression operation.

Here, a side of the bent portion 10 which is close to the drive shaft 2 is referred to as a bent portion inner peripheral wall 10*a*, and a side of the bent portion 10 which is distant therefrom is referred to as a bent portion outer peripheral wall 10*b*. When the flow direction of the cooling air is changed in the bent portion 10, a main stream can be formed along the bent portion outer peripheral wall 10*b* because of the centrifugal force. Accordingly, in this example, since the bent portion outer peripheral wall 10*b* is formed by a plane that intersects a plane perpendicular to the drive shaft 2 at an angle θ which is an obtuse angle (90° to 180°), the foregoing main stream of the cooling air is prevented from separating from the bent portion inner peripheral wall 10*a*.

Hereinafter, the flow characteristics of the cooling air in this example will be described in comparison to a structure of the related art illustrated in FIG. 7.

Figure 7:
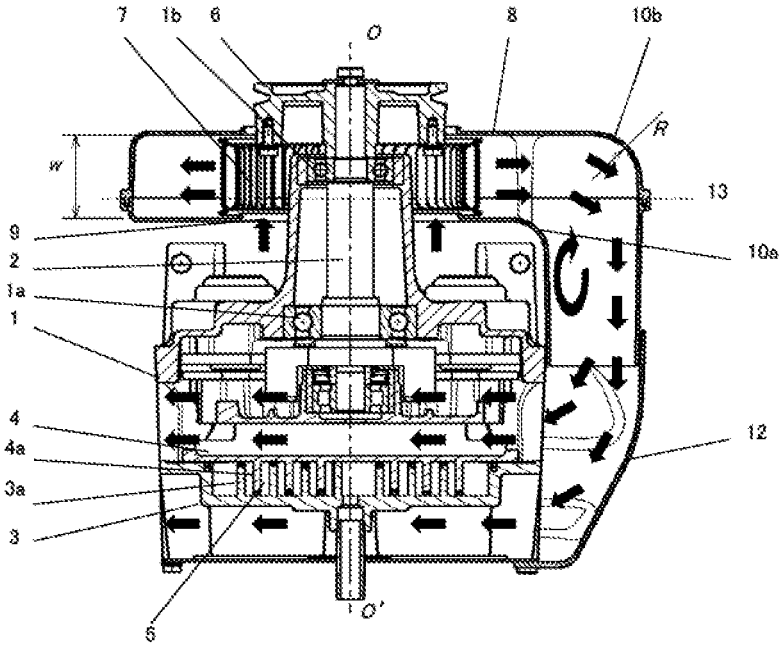
FIG. 7 is a view illustrating the flow of cooling air of a scroll-type fluid machine in the related art.

As illustrated in FIG. 7, in the structure of the related art, the bent portion outer peripheral wall 10*b* is formed by a curved surface having a radius R smaller than a thickness W of the cooling air duct 8 in the axial direction, and a main stream of cooling air separates from the bent portion inner peripheral wall 10*a*. For this reason, the flow speed in the vicinity of the bent portion outer peripheral wall 10*b* in the cooling air passage 11 becomes high, and a flow vortex of the cooling air is generated in the vicinity of a connection portion between the bent portion inner peripheral wall 10*a* and the cooling air passage 11 to cause noise or a loss of the cooling air.

In addition, Patent Document 2 discloses a configuration where the flow in the bent portion and the cooling air passage is improved since a bent portion outer peripheral wall is formed by a curved surface having a radius greater than the thickness of a cooling air duct in the axial direction. However, in this configuration, since the dividing planes of components forming the cooling air duct are a plurality of planes which are disposed diagonally to each other, a mold for producing each component becomes large in a height direction, and the mold cost becomes expensive, and thus, there is a problem in cost or productivity. On the other hand, in this example, since the bent portion outer peripheral wall 10*b* is formed by a plane that intersects the plane perpendicular to the drive shaft 2 at an obtuse angle (90° to 180°), the foregoing main stream of the cooling air is prevented from separating from the bent portion inner peripheral wall 10*a*.

Figure 4:
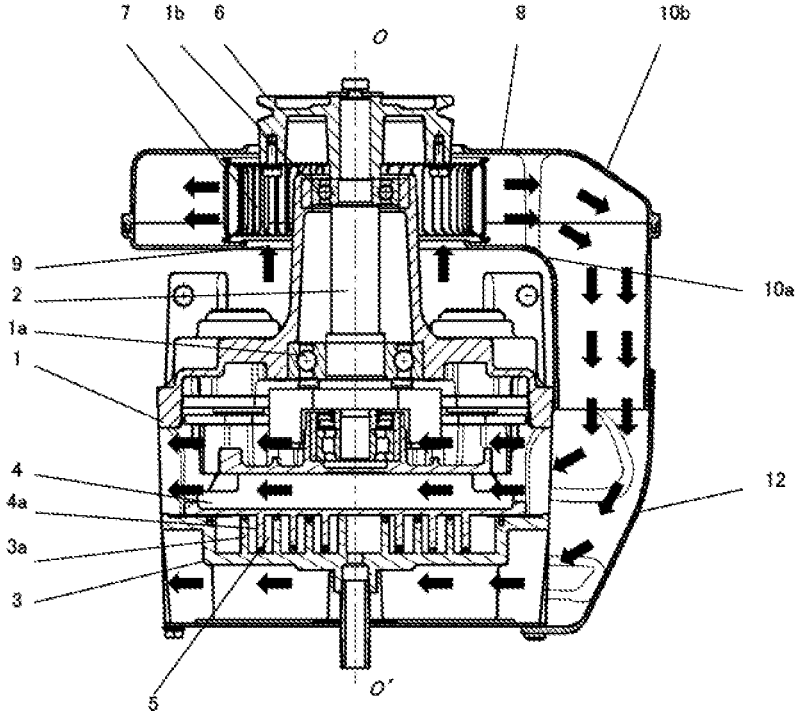
FIG. 4 is a view illustrating the flow of cooling air in the scroll-type fluid machine in the first example.

FIG. 4 is a view illustrating the flow of the cooling air in the scroll-type fluid machine of this example. As illustrated in FIG. 4, since the bent portion outer peripheral wall 10*b* is formed by a plane that intersects the plane perpendicular to the drive shaft 2, namely, a plane parallel to an outer peripheral wall of the cooling air passage in the cooling air duct 8 which covers the cooling fan 7 and is disposed along the direction perpendicular to the drive shaft 2, at an obtuse angle, the cooling air can flow without generating a vortex in the vicinity of the bent portion inner peripheral wall 10*a* in the cooling air passage 11; and thereby, it is possible to prevent noise or a loss of the cooling air which is caused by the vortex. Incidentally, the plane of the bent portion outer peripheral wall 10*b* may be formed of a plurality of planes.

In addition, as illustrated in FIG. 1, since a relationship between a length L1 of the bent portion outer peripheral wall 10*b* when the bent portion outer peripheral wall 10*b* is projected on a plane parallel to the axial direction and the thickness W of the cooling air duct 8 in the axial direction satisfies L1<W, the components forming the cooling air duct 8 can be configured such that the components are divided by a dividing plane 13 perpendicular to the drive shaft 2; and thereby, it is possible to improve the productivity. Incidentally, when the cooling air duct 8 can be divided within the thickness W in the axial direction, it is possible to improve the productivity, and thus, the cooling air duct 8 may be divided not by one plane but by a plurality of planes.

Second Example

Figure 5:
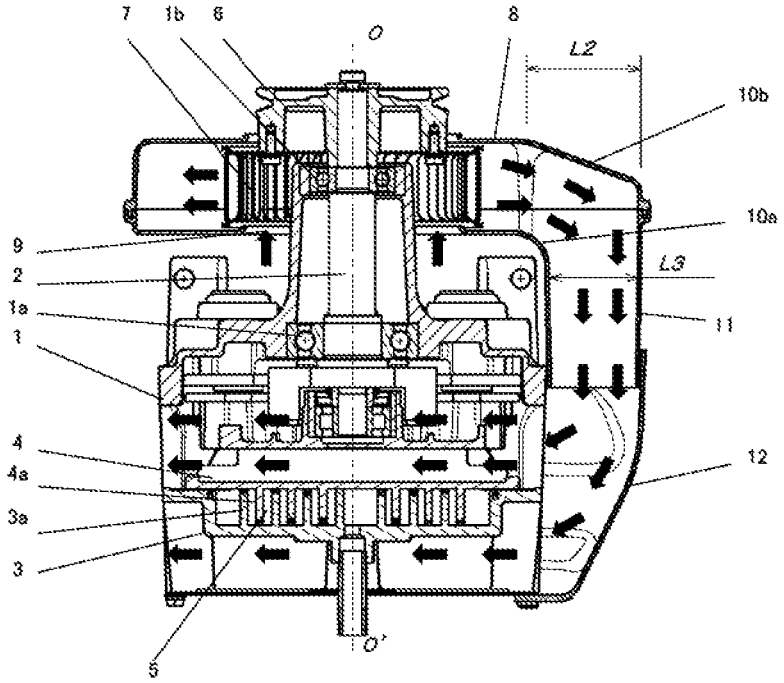
FIG. 5 is a cross-sectional view of a scroll-type fluid machine in a second example.

FIG. 5 is a cross-sectional view of a scroll-type fluid machine in this example. In FIG. 5, the same reference signs will be assigned to the same configurations as those in the first example, and the descriptions thereof will be omitted.

As illustrated in FIG. 5, this example is characterized in that a relationship between a length L2 of the bent portion outer peripheral wall 10*b* when the bent portion outer peripheral wall 10*b* is projected on the plane perpendicular to the axial direction and a length L3 of the cooling air passage 11 when the cooling air passage 11 is projected on the plane perpendicular to the axial direction satisfies L2>L3. Therefore, in this example, compared to the first example, a position where the flow of the cooling air is changed to the direction of the cooling air passage 11 can be brought closer to the axial direction; and thereby, it is possible to increase the effect of preventing a mainstream of the cooling air separating from the bent portion inner peripheral wall 10*a*. For this reason, the cooling air can flow without generating a vortex in the vicinity of the bent portion inner peripheral wall 10*a* of the cooling air passage 11; and thereby, it is possible to prevent noise or a loss of the cooling air which is caused by the vortex.

Third Example

Figure 6:
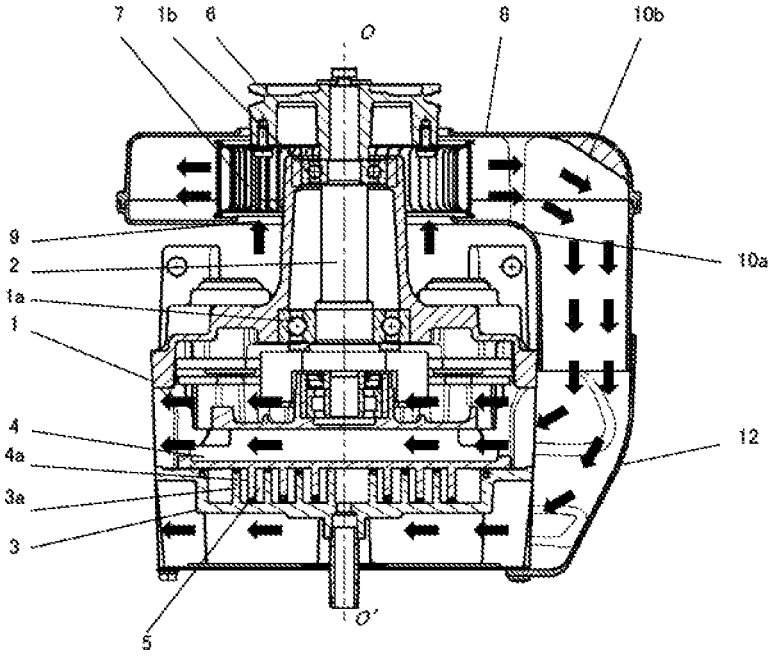
FIG. 6 is a cross-sectional view of a scroll-type fluid machine in a third example.

FIG. 6 is a cross-sectional view of a scroll-type fluid machine in this example. In FIG. 6, the same reference signs will be assigned to the same configurations as those in the first and second examples, and the descriptions thereof will be omitted.

As illustrated in FIG. 6, this example is characterized in that a plurality of components forming the bent portion outer peripheral wall 10*b* are provided in a thickness direction of the bent portion outer peripheral wall 10*b*. Namely, separately from components forming the cooling air duct 8, substantially, the inside of the bent portion through which the cooling air passes is formed of a member which is separate from the plane forming the bent portion outer peripheral wall 10*b* illustrated in the first and second examples. Therefore, in this example, it is possible to obtain the same effects as those in the first and second examples by adding a different component also to the cooling air duct of the related art.

In the examples described above, the scroll-type compressor has been described as an example of the scroll-type fluid machine; however, the present invention is not limited thereto, and as long as a fluid machine aims to improve the cooling efficiency, the present invention is not limited to the scroll-type compressor but also can be applied to, for example, a scroll-type expander.

The examples described above are merely specific examples for carrying out the present invention, and the technical scope of the present invention should not be interpreted in a limited manner by the examples. Namely, the present invention can be carried out in various forms without departing from the technical concept thereof or the main characteristics thereof.

REFERENCE SIGNS LIST

1 Casing
1*a*, 1*b* Bearing
2 Drive shaft
3 Fixed scroll
3*a* Fixed scroll lap portion
4 Orbiting scroll
4*a* Orbiting scroll lap portion
5 Compression chamber
6 Pulley
7 Cooling fan
8 Cooling air duct
9 Suction port
10 Bent portion
10*a* Bent portion inner peripheral wall
10*b* Bent portion outer peripheral wall
11 Cooling air passage
12 Introduction duct
13 Dividing plane

The invention claimed is:

1. A scroll-type fluid machine comprising:
a fixed scroll that is provided with a lap portion having a spiral shape;
an orbiting scroll that is provided with a lap portion having a spiral shape which forms a compression chamber between the lap portion of the fixed scroll and the lap portion;
a drive shaft that is connected to the orbiting scroll and rotates to cause the orbiting scroll to orbit;
a cooling fan that is provided on a side of the drive shaft, the side being opposite to the orbiting scroll, to generate a cooling air; and
a cooling air duct through which the cooling air generated by the cooling fan flows to the fixed scroll and the orbiting scroll, wherein
in a bent portion, immediately adjacent to the cooling fan, where a direction of the cooling air duct is changed from a direction perpendicular to the drive shaft to a direction of the drive shaft, a part of an outer peripheral wall which is distant from the drive shaft is planar and defines a plane which intersects a plane perpendicular to the drive shaft at an obtuse angle.

2. The scroll-type fluid machine according to claim 1,
wherein the cooling fan is accommodated in the cooling air duct, and
a length L1 of a plane forming the outer peripheral wall of the bent portion when the plane is projected on a plane parallel to the drive shaft is shorter than a thickness W of a portion of the cooling air duct in the direction of the drive shaft, the portion covering the cooling fan.

3. The scroll-type fluid machine according to claim 2,
wherein the cooling air duct is divided by a dividing plane within the thickness W in the direction of the drive shaft.

4. The scroll-type fluid machine according to claim 3,
wherein the cooling air duct is divided by the dividing plane perpendicular to the drive shaft.

5. The scroll-type fluid machine according to claim 1,
wherein a length L2 of a plane forming the outer peripheral wall of the bent portion when the plane is projected on the plane perpendicular to the drive shaft is longer than a length L3 of a cooling air passage of the cooling air duct, the cooling air passage being disposed along the direction of the drive shaft, when the cooling air passage is projected on the plane perpendicular to the direction of the drive shaft.

6. The scroll-type fluid machine according to claim 1,
wherein a plane forming the outer peripheral wall of the bent portion is formed by a component which is separate from a component forming the cooling air duct.

7. A scroll-type fluid machine comprising:
a fixed scroll that is provided with a lap portion having a spiral shape;
an orbiting scroll that is provided with a lap portion having a spiral shape which forms a compression chamber between the lap portion of the fixed scroll and the lap portion;

a drive shaft that is connected to the orbiting scroll and rotates to cause the orbiting scroll to orbit;

a cooling fan that is provided on a side of the drive shaft, the side being opposite to the orbiting scroll, to generate a cooling air; and a cooling air duct including a first cooling air passage that covers the cooling fan and is disposed along a direction perpendicular to the drive shaft, a second cooling air passage that extends in a direction of the drive shaft, a bent portion that is immediately adjacent to the cooling fan and that connects the first cooling air passage to the second cooling air passage, and an introduction duct that is connected to the second cooling air passage to supply the cooling air to the fixed scroll and the orbiting scroll, wherein a part of an outer peripheral wall of the bent portion, the outer peripheral wall being distant from the drive shaft, is planar and defines a plane which intersects a plane perpendicular to the drive shaft at an obtuse angle.

8. A scroll-type fluid machine which includes a fixed scroll and an orbiting scroll, in which the orbiting scroll is provided at one end of a drive shaft and a cooling fan is provided at the other end of the drive shaft, and which includes a cooling air duct through which a cooling air generated by the cooling fan flows to the fixed scroll and the orbiting scroll, wherein the cooling air duct includes a first cooling air passage that covers the cooling fan and is disposed along a direction perpendicular to the drive shaft, a second cooling air passage that extends in a direction of the drive shaft, and a bent portion that is immediately adjacent to the cooling fan and that connects the first cooling air passage to the second cooling air passage, and a part of an outer peripheral wall of the bent portion, the outer peripheral wall being distant from the drive shaft, is planar and defines a plane which intersects a plane parallel to an outer peripheral wall of the first cooling air passage at an obtuse angle.

9. The scroll-type fluid machine according to claim 1, wherein the cooling air flows without generating a vortex in the vicinity of the bent portion inner peripheral wall in the cooling air passage, and the plane of the bent portion outer peripheral wall is formed by a plurality of planes.

* * * * *